US009879851B2

(12) United States Patent
Ohno et al.

(10) Patent No.: US 9,879,851 B2
(45) Date of Patent: Jan. 30, 2018

(54) LAMP HAVING OUTWARDLY ORIENTATED LIGHT SOURCE UNITS AND INWARDLY ORIENTATED HEAT SINKS WITH TRANSVERSELY ORIENTATED FINS

(71) Applicant: IWASAKI ELECTRIC CO., LTD., Tokyo (JP)

(72) Inventors: Atsushi Ohno, Gyoda (JP); Takayoshi Imanari, Gyoda (JP); Moriyuki Sekine, Gyoda (JP)

(73) Assignee: IWASAKI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/917,763

(22) PCT Filed: Jun. 9, 2014

(86) PCT No.: PCT/JP2014/065247
§ 371 (c)(1),
(2) Date: Mar. 9, 2016

(87) PCT Pub. No.: WO2015/045494
PCT Pub. Date: Apr. 2, 2015

(65) Prior Publication Data

US 2016/0223184 A1 Aug. 4, 2016

(30) Foreign Application Priority Data

Sep. 25, 2013 (JP) ..... 2013-198279

(51) Int. Cl.
*F21V 15/015* (2006.01)
*F21V 25/00* (2006.01)
(Continued)

(52) U.S. Cl.
CPC ..... *F21V 29/767* (2015.01); *F21K 9/23* (2016.08); *F21K 9/90* (2013.01); *F21S 2/005* (2013.01);
(Continued)

(58) Field of Classification Search
CPC ..... F21V 29/745
See application file for complete search history.

(56) References Cited

U.S. PATENT DOCUMENTS 7,637,636 B2 * 12/2009 Zheng ..... F21S 2/005 362/294
7,654,699 B2 * 2/2010 Chang ..... F21V 29/02 362/294
(Continued)

FOREIGN PATENT DOCUMENTS

JP 06-041191 U 5/1994
JP 06-188343 A 7/1994
(Continued)

OTHER PUBLICATIONS

Extended European Search Report dated Jan. 25, 2017 for the corresponding European Patent Application No. 14847858.9.
(Continued)

*Primary Examiner* — Jong-Suk (James) Lee
*Assistant Examiner* — Colin Cattanach
(74) *Attorney, Agent, or Firm* — Leason Ellis LLP

(57) ABSTRACT

An LED lamp is equipped with a plurality of light source units each having a mounting board on which a light emitting element is mounted, on a front surface of a substrate, the plurality of light source units are disposed around an axis C of the LED lamp with back surfaces of the respective substrates facing inside, and gaps G1 left from one another, and heat radiation fins that are disposed to be
(Continued)

inclined with respect to an axial direction of the axis C are provided on the back surface of the substrate.

9 Claims, 12 Drawing Sheets

(51) Int. Cl.

| | |
|---|---|
| ***F21V 29/76*** | (2015.01) |
| ***F21K 9/90*** | (2016.01) |
| ***F21S 2/00*** | (2016.01) |
| ***F21V 19/04*** | (2006.01) |
| ***F21V 29/74*** | (2015.01) |
| ***F21V 29/75*** | (2015.01) |
| ***F21K 9/23*** | (2016.01) |
| ***F21V 29/83*** | (2015.01) |
| *F21Y 115/10* | (2016.01) |

(52) U.S. Cl.
CPC ..... *F21V 15/015* (2013.01); *F21V 19/045* (2013.01); *F21V 25/00* (2013.01); *F21V 29/745* (2015.01); *F21V 29/75* (2015.01); *F21V 29/83* (2015.01); *F21Y 2115/10* (2016.08)

(56) References Cited

U.S. PATENT DOCUMENTS

| | | | | |
|---|---|---|---|---|
| 7,810,968 | B1 * | 10/2010 | Walker | F21S 8/08 362/218 |
| 7,934,851 | B1 * | 5/2011 | Boissevain | F21S 2/005 362/241 |
| 8,123,378 | B1 * | 2/2012 | Ruberg | F21S 8/088 362/249.02 |
| 8,123,382 | B2 * | 2/2012 | Patrick | F21V 29/004 362/218 |
| 8,197,091 | B1 * | 6/2012 | Kyle | F21V 29/004 362/249.06 |
| 9,030,120 | B2 * | 5/2015 | Pickard | F21V 29/87 315/291 |
| 9,134,012 | B2 * | 9/2015 | Wu | F21V 14/02 |
| 9,243,758 | B2 * | 1/2016 | Pickard | F21V 29/004 |
| 2006/0097385 | A1 * | 5/2006 | Negley | H01L 33/486 257/722 |
| 2009/0303717 | A1 * | 12/2009 | Long | F21K 9/00 362/249.02 |
| 2010/0006261 | A1 * | 1/2010 | Ishida | B61C 17/00 165/86 |
| 2010/0033969 | A1 * | 2/2010 | Hochstein | F21K 9/00 362/249.03 |
| 2010/0079984 | A1 * | 4/2010 | Liu | F21S 9/037 362/183 |
| 2010/0097796 | A1 * | 4/2010 | Liu | F21S 8/088 362/234 |
| 2011/0018437 | A1 * | 1/2011 | Rossi | F21V 3/02 315/35 |
| 2011/0074269 | A1 | 3/2011 | Hisayasu et al. | |
| 2013/0299125 | A1 * | 11/2013 | Shi | H01L 23/467 165/47 |
| 2014/0328064 | A1 | 11/2014 | Mikami et al. | |
| 2014/0360699 | A1 * | 12/2014 | van Schoor | F28F 13/06 165/96 |
| 2015/0292718 | A1 | 10/2015 | Mikami et al. | |

FOREIGN PATENT DOCUMENTS

| | | | |
|---|---|---|---|
| JP | 07-249885 | A | 9/1995 |
| JP | 2009-104858 | A | 5/2009 |
| JP | 2011-070972 | A | 4/2011 |
| JP | 2013-122899 | A | 6/2013 |
| WO | WO-2008/035452 | A | 3/2008 |

OTHER PUBLICATIONS

International Search Report dated Jul. 8, 2014 for the corresponding PCT Application No. PCT/JP2014/065247.
International Preliminary Report on Patentability and Written Opinion dated Apr. 7, 2016 for the corresponding PCT Application No. PCT.JP2014/065247(original Written Opinion was issued in Japanese on Jul. 8, 2014).
Office Action dated Feb. 3, 2015 for the corresponding Japanese Patent Application No. 2013-198279.
Office Action dated May 19, 2015 for the corresponding Japanese Patent Application No. 2013-198279.
Office Action dated Oct. 30, 2017 for the corresponding European Patent Application No. 14847858.9.

* cited by examiner

LAMP HAVING OUTWARDLY ORIENTATED LIGHT SOURCE UNITS AND INWARDLY ORIENTATED HEAT SINKS WITH TRANSVERSELY ORIENTATED FINS

CROSS-REFERENCE TO RELATED PATENT APPLICATIONS

This application is a U.S. National Phase application under 35 U.S.C. §371 of International Patent Application No. PCT/JP2014/065247, filed Jun. 9, 2014, and claims the benefit of Japanese Patent Application No. 2013-198279, filed Sep. 25, 2013, all of which are incorporated by reference in their entirety herein. The International application was published in Japanese on Apr. 2, 2015 as International Publication No. WO/2015/045494 under PCT Article 21(2).

FIELD OF THE INVENTION

The present invention relates to a lamp equipped with heat radiation fins.

BACKGROUND OF THE INVENTION

There has been conventionally known a lamp that is equipped with a plurality of light source units each having a mounting board on which light emitting elements are mounted, on a front surface of a substrate, wherein these plurality of light source units are disposed around the axis of the lamp with back surfaces of the respective substrates facing inside, and with gaps left from one another (refer to Japanese Patent-Laid Open No. 2013-122899, for example). In Patent Literature 1, heat radiation fins provided on the back surfaces of the substrates are formed to be parallel with the axis of the lamp.

Technical Problem

However, in the above described conventional lamp, air around the heat radiation fins flows in the axial direction of the lamp along the heat radiation fins, so that heat easily accumulates in a portion at a downstream side of the heat radiation fins, and there is the problem of efficiency of radiation.

The present invention is made in the light of the aforementioned circumstances, and has an object to enable heat of a lamp to be radiated efficiently by heat radiation fins.

SUMMARY OF THE INVENTION

Solution to Problem

In order to attain the above described object, the present invention provides a lamp equipped with a plurality of light source units each having a mounting board on which a light emitting element is mounted, on a front surface of a substrate, in which the plurality of light source units are disposed around an axis of the lamp with back surfaces of the respective substrates facing inside, and gaps left from one another, wherein on the back surface of the substrate, a heat radiation fin that is disposed to be inclined with respect to an axial direction of the axis is provided.

In the aforementioned configuration, the light source unit may be formed to be longer in the axial direction than in a width direction thereof, and a plurality of light emitting elements may be disposed side by side in the axial direction.

In the aforementioned configuration, an inclination angle of the heat radiation fin with respect to a reference line orthogonal to the axis may be in a range from 25° to 85°.

In the aforementioned configuration, an interval between the heat radiation fins may be in a range from 4 mm to 11 mm.

In the aforementioned configuration, the heat radiation fin may be formed so that a height at a discharge side is higher than a height at an inlet side of air.

In the aforementioned configuration, heat radiation fins of the adjacent light source units may be formed to be substantially symmetrical, with the axis as the reference.

Advantageous Effect of Invention

According to the present invention, heat of the lamp can be efficiently radiated by the heat radiation fins.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Hereinafter, embodiments of the present invention will be described with reference to the drawings.

First Embodiment

Figure 1:
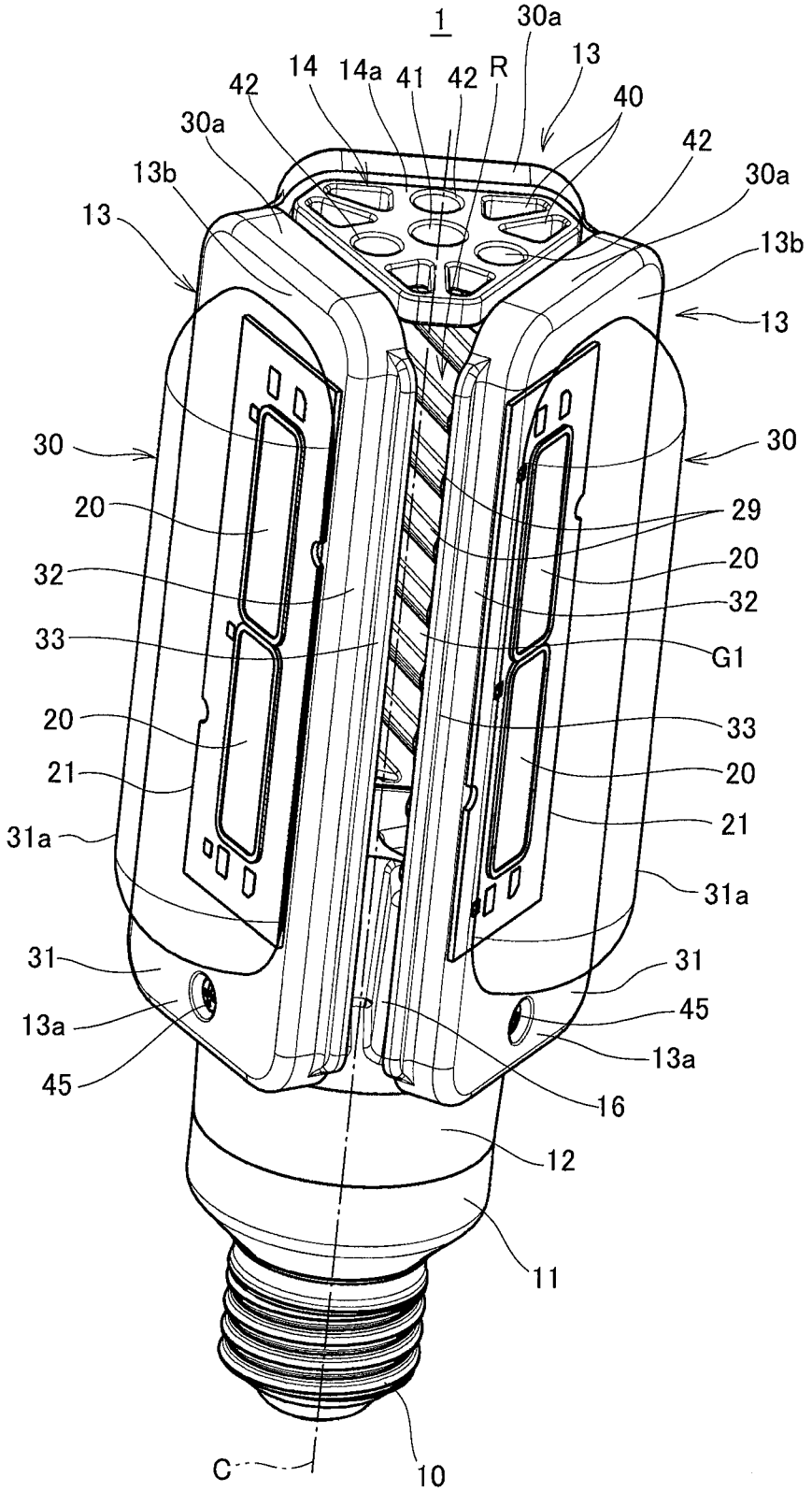
FIG. 1 is a perspective view of an LED lamp according to a first embodiment.
Figure 2:
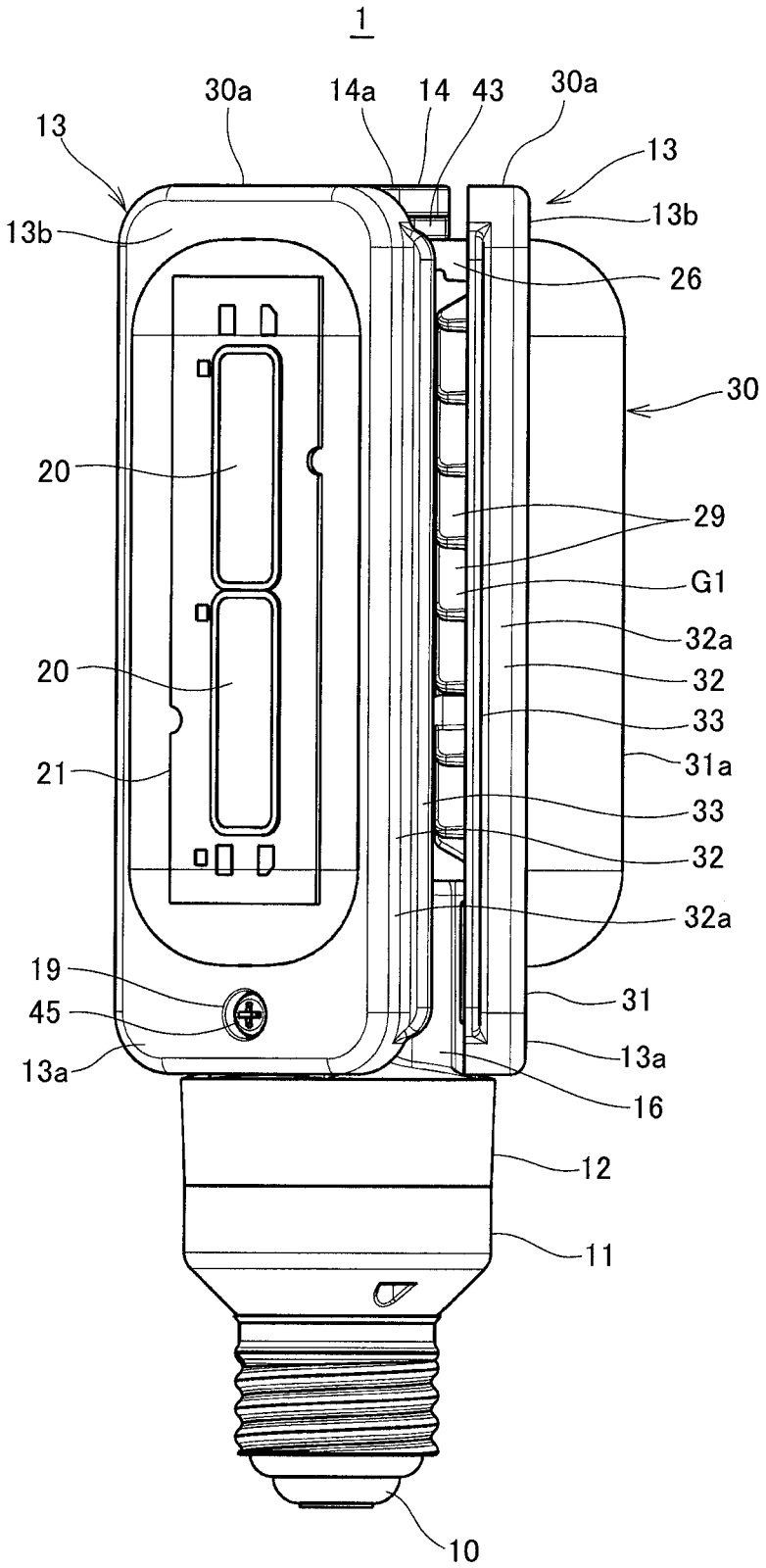
FIG. 2 is a side view of the LED lamp.
Figure 3:
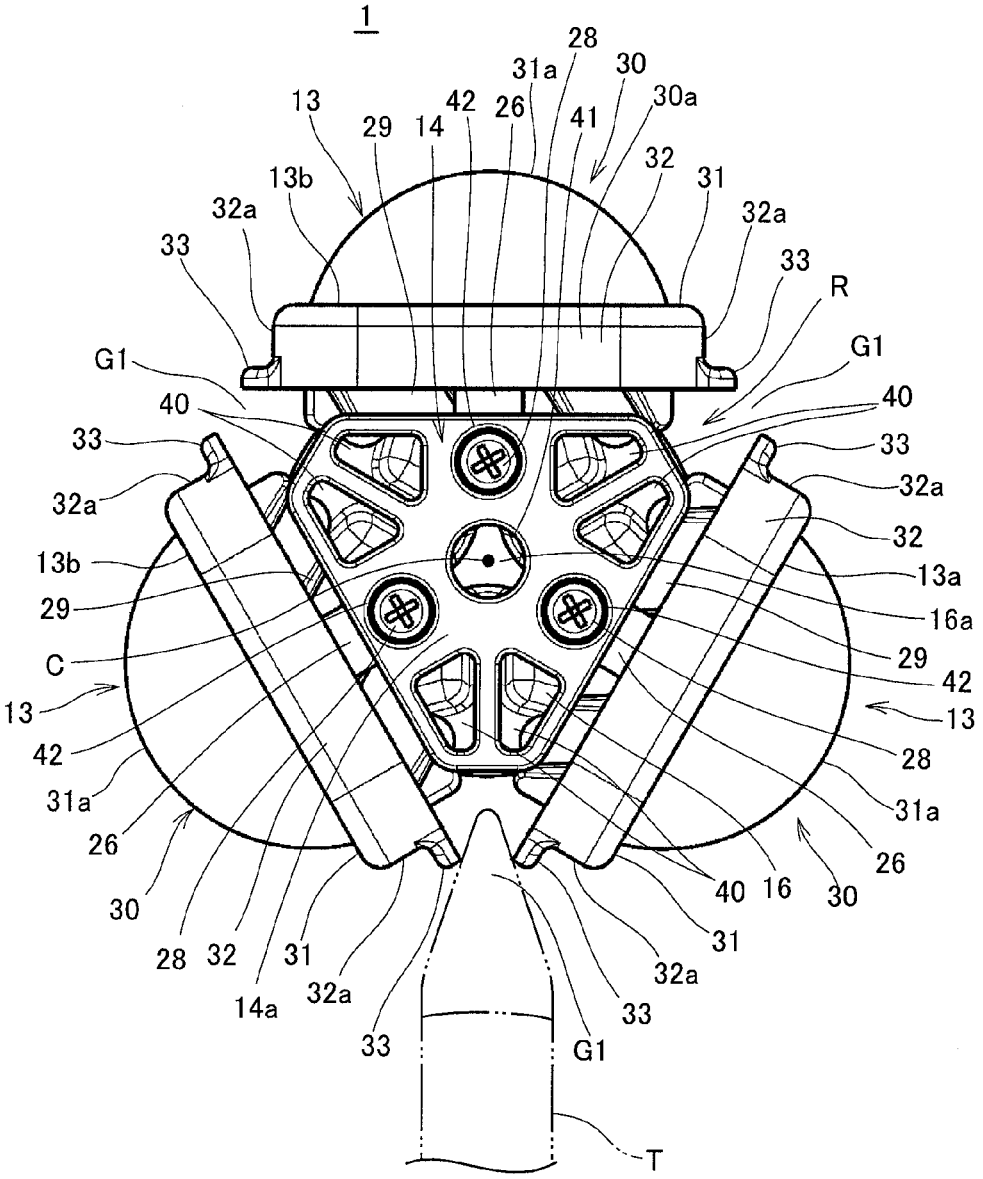
FIG. 3 is a plan view of the LED lamp.
Figure 4:
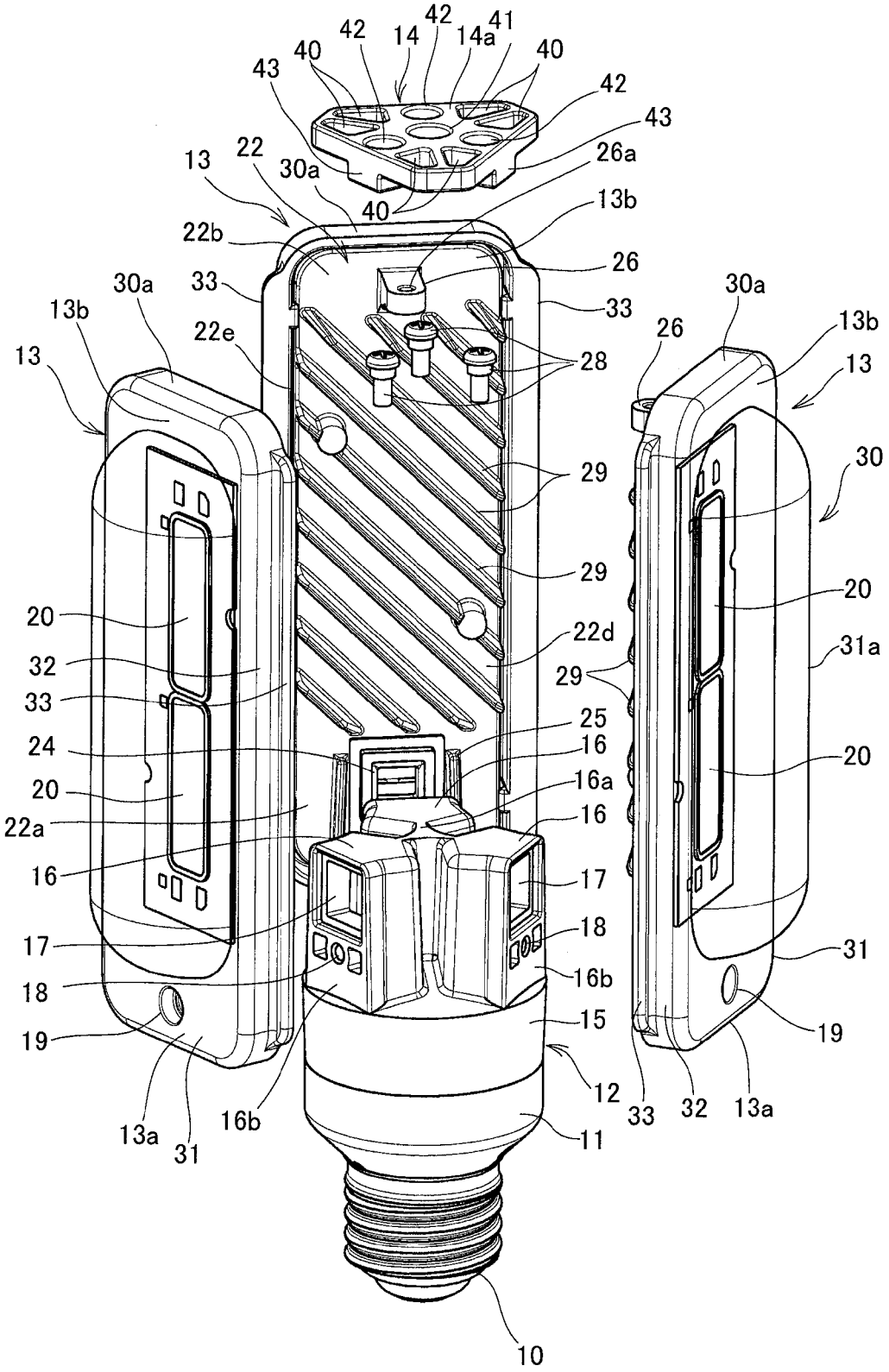
FIG. 4 is an exploded perspective view of the LED lamp.

FIG. 1 to FIG. 4 are views showing a configuration of an LED lamp 1 according to a first embodiment; FIG. 1 is a perspective view, FIG. 2 is a side view, FIG. 3 is a plan view and FIG. 4 is an exploded perspective view.

As shown in FIG. 1, the LED lamp 1 is a cap type lamp using LEDs 20 as an example of a light emitting element in a light source, and can be used by fitting a cap 10 into an existing socket. The LED lamp 1 extends in a rod shape with synchrotron radiation emitted substantially uniformly from an entire periphery thereof, similarly to an arc tube of an HID lamp (a discharge lamp), and has such a light output as to be usable in place of an existing discharge lamp of a high output type like an HID lamp.

Note that a discharge lamp is lit with AC power, whereas a light emitting element such as an LED is lit with DC power. Accordingly, when the LED lamp 1 having the LEDs 20 as the light source is to be lit with an AC commercial power supply, DC power is supplied to the LED lamp 1 through a power supply circuit that converts the commercial power source into DC power. The LED lamp 1 of the present embodiment is configured so that a power supply circuit is not built therein, but the power supply circuit is provided at a side of a socket, and DC power is inputted from the socket through the cap 10. In other words, when the LED lamp 1 is to be fitted into a lighting tool for an existing discharge lamp, the lighting tool is used by replacing a stabilizer provided in the lighting tool with a power supply circuit.

Next, a configuration of the LED lamp 1 will be described in detail.

As shown in FIG. 1 to FIG. 4, the LED lamp 1 is equipped with the above described cap 10, a cylindrical mounting body 11 with the cap 10 mounted to one end, a cylindrical supporter 12 that is connected to the other end of the mounting body 11, a plurality (three in the present embodiment) of light source units 13 that are disposed to surround the supporter 12 from around and supported by the supporter 12, and a coupling member 14 that couples the respective light source units 13 to one another. The LED lamp 1 is a long and narrow lamp extending in a rod shape, and the respective light source units 13 are disposed to surround an axis C passing through a center of the rod shape of the LED lamp 1 from around. The axis C substantially corresponds to a center axis of the cap 10.

The cap 10 is of a screwed type (turn-insertion type) that is generally called an E type cap such as an E26 type or an E39 type, is configured to be adapted to an existing size, and is fittable to an existing socket by being screwed into the existing socket. A DC current from the lighting power supply is supplied to the cap 10 through a socket not illustrated, and the respective light source units 13 are lit. Note that the cap 10 of an insertion type may be used.

Figure 5:
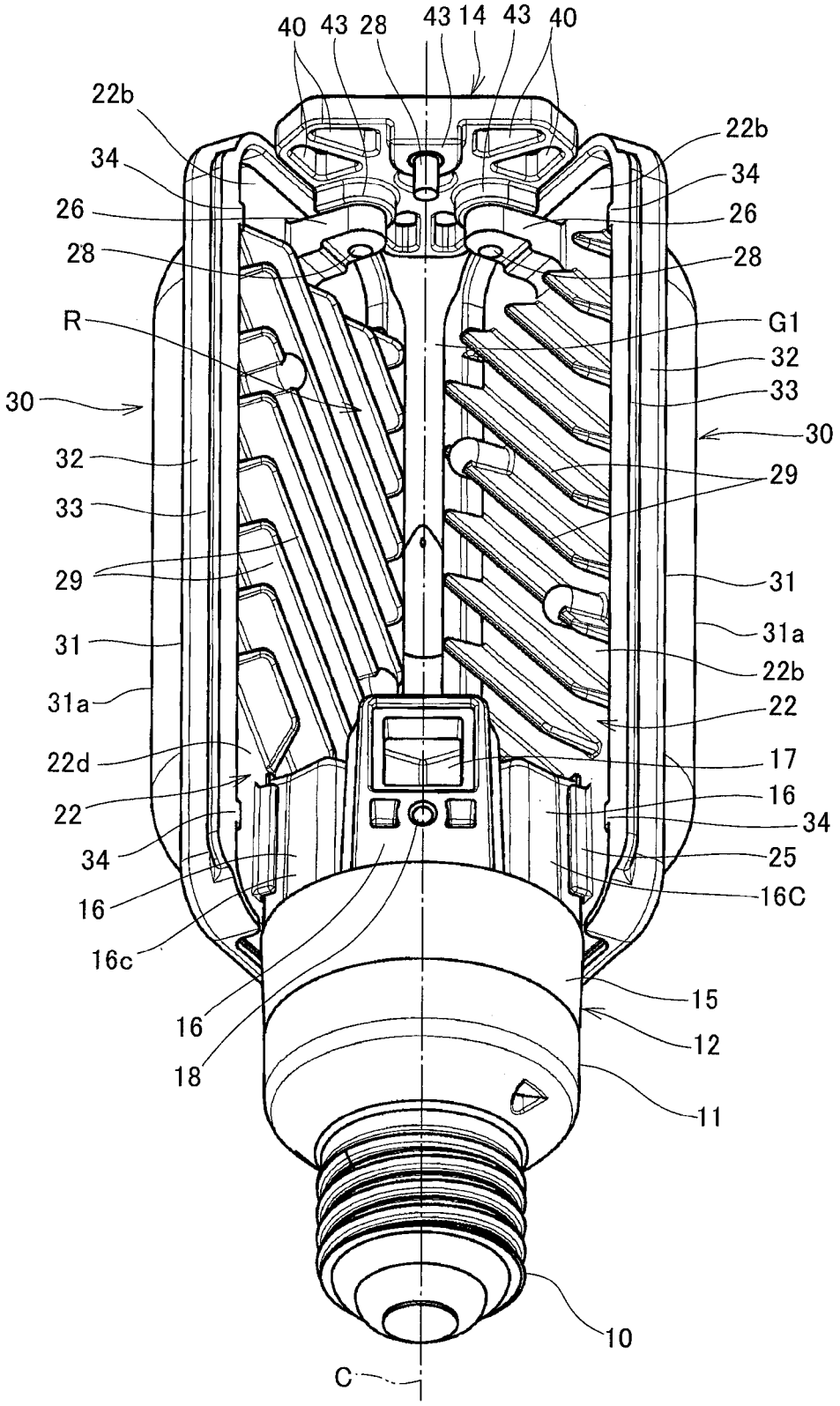
FIG. 5 is a perspective view of the LED lamp in a state where one of light source units is removed.

FIG. 5 is a perspective view of the LED lamp 1 in a state where one of the light source units 13 is removed.

As shown in FIG. 4 and FIG. 5, the supporter 12 is equipped with a tubular portion 15 connected to the mounting body 11, and a plurality of mounting portions 16 that are vertically provided on an end surface of the tubular portion 15 in such a manner as to surround the axis C from around. The supporter 12 is formed from a resin material provided with an electrical insulating property.

One end portion 13*a* of the light source unit 13 is mounted on the mounting portion 16. The mounting portions 16 are provided in positions corresponding to the light source units 13, and are provided at three spots equidistantly (intervals of 120°) in a circumferential direction of the tubular portion 15 in the present embodiment. The respective mounting portions 16 are integrally coupled by a coupling portion 16*a* provided in a position overlapping the axis C.

In an outer peripheral surface 16*b* of each of the mounting portions 16, an introduction hole 17 that communicates with an inside of the mounting portion 16 is formed. A lead wire (not illustrated) of the light source unit 13 is passed through the introduction hole 17, and the lead wire passes through insides of the supporter 12 and the mounting body 11 from the introduction hole 17, and is connected to the cap 10.

In the outer peripheral surface 16*b*, a screw hole portion 18 is formed under the introduction hole 17. The light source units 13 have fixing hole portions 19 at one end portions 13*a* in a longitudinal direction, and are fixed to the outer peripheral surfaces 16*b* of the respective mounting portions 16 by screws 45 that are inserted through the fixing hole portions 19 and fastened to the screw hole portions 18. That is, the respective light source units 13 have the one end portions 13*a* supported by the mounting portions 16, extend upward along the axis C in such a manner as to surround the axis C, and are supported at the supporter 12 in a cantilever manner.

As the light source units 13 are disposed to surround the axis C, a space R which allows air to flow is formed in an inner side from the light source units 13.

As shown in FIG. 3 to FIG. 5, the other end portions 13*b* in the longitudinal direction of the light source unit 13 are coupled to one another by the coupling member 14. The coupling member 14 is a plate-shaped lid body and closes an end in the direction of the axis C, of the space R. In the present embodiment, the coupling member 14 is formed into a shape of a substantially equilateral triangle in accordance with a shape of the space R in plan view. The coupling member 14 is formed from an electrically insulating material which insulates electricity, and is formed from an insulative plastic, for example. In this way, the other end portions 13*b* of the light source units 13 are configured to be connected to each other by the coupling member 14, and thereby the space R can be ensured to be large while rigidity of the LED lamp 1 is effectively ensured.

Figure 6:
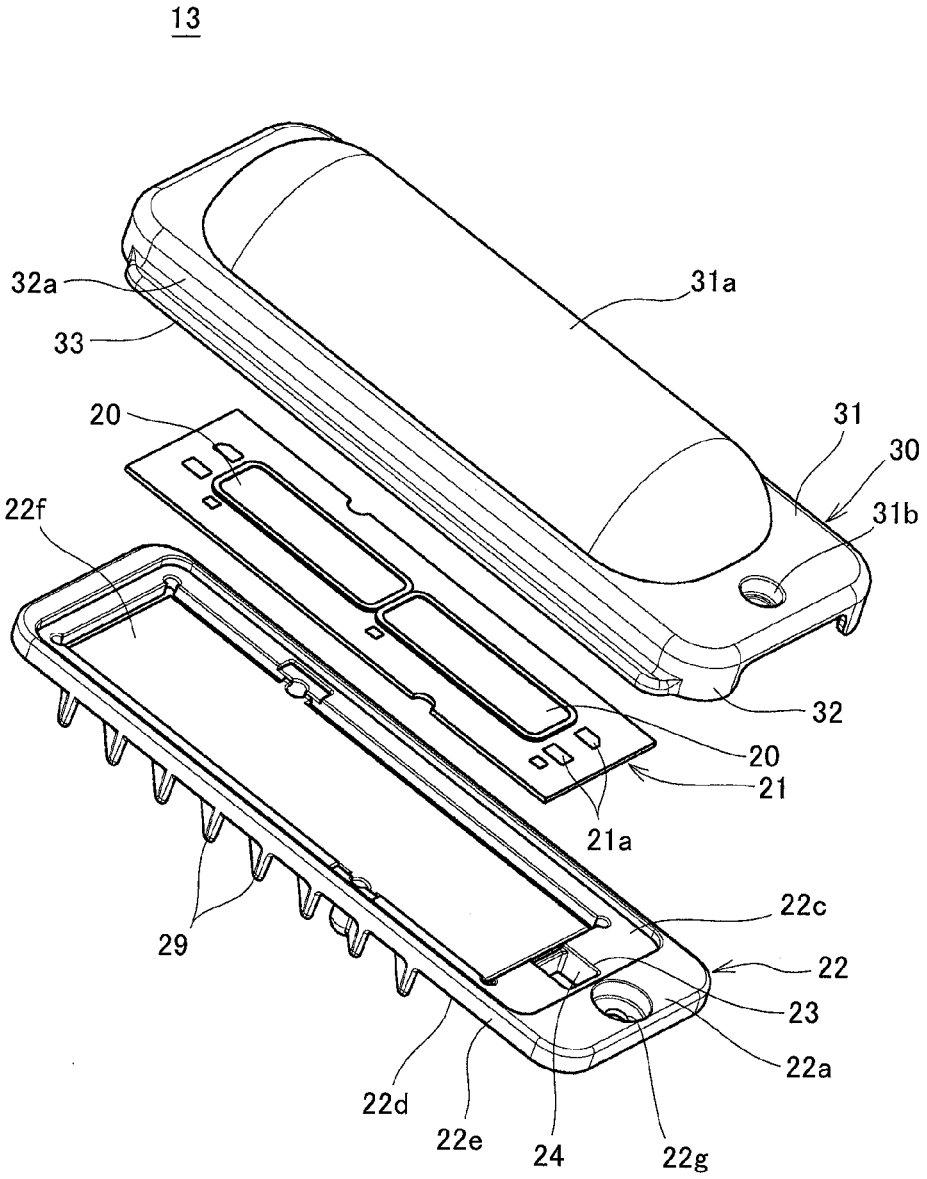
FIG. 6 is an exploded perspective view of the light source unit.
Figure 7:
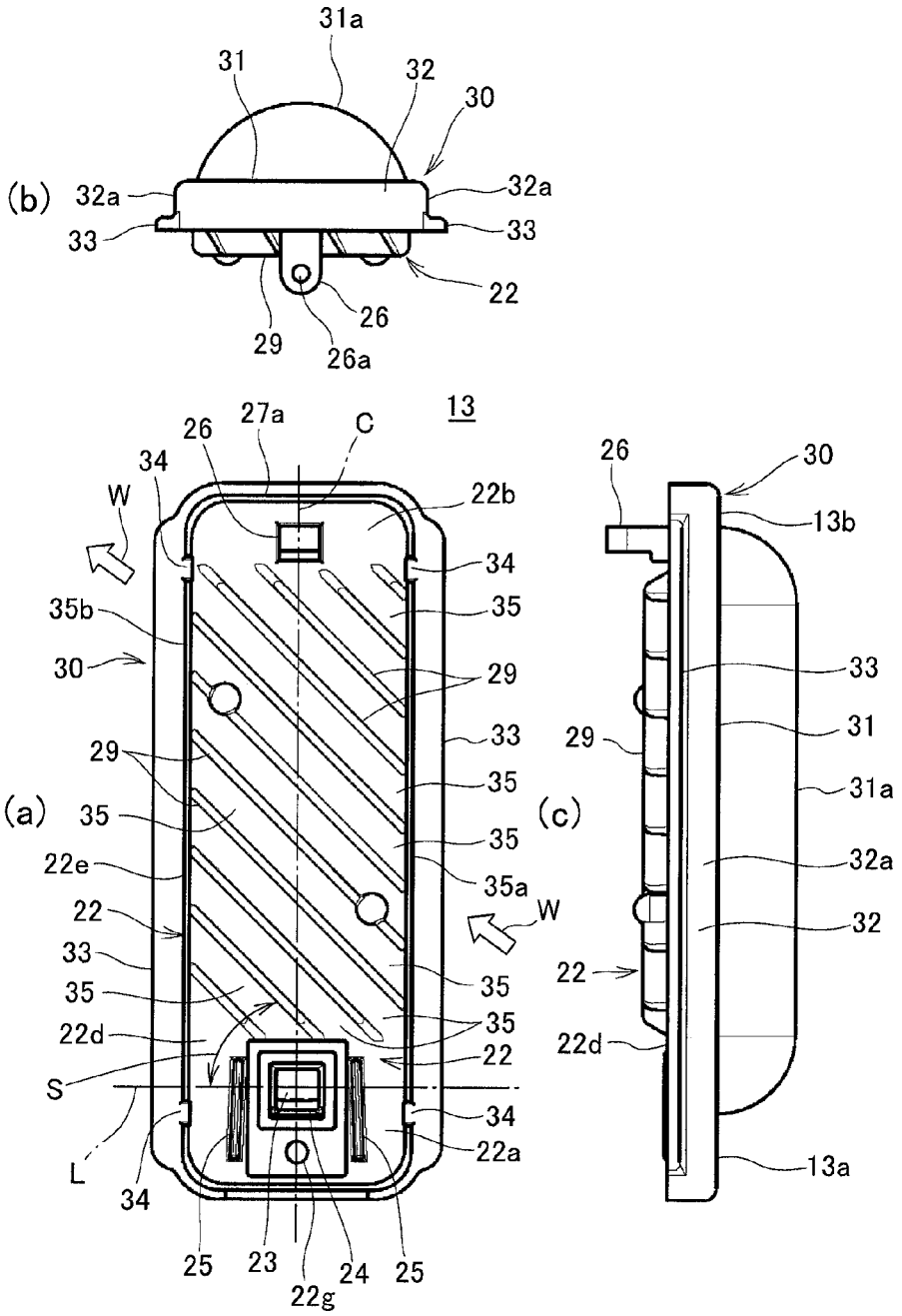
FIG. 7 is a view showing the light source unit, (a) is a front view of the light source unit seen from a back face, (b) is a plan view, and (c) is a side view.

FIG. 6 is an exploded perspective view of the light source unit 13. FIG. 7 is a view showing the light source unit 13, (a) is a front view of the light source unit 13 seen from a back surface, (b) is a plan view, and (c) is a side view.

The light source unit 13 emits synchrotron radiation with the LED 20 as a light source, and is configured by being modularized into a rectangular shape extending along the axis C. The light source unit 13 is formed to be longer in the direction of the axis C than in a width direction thereof, and is formed into an oblong in front view.

The LED lamp 1 of the present embodiment is equipped with the three light source units 13, and these light source units 13 are arranged in a ring shape equidistantly from one another around the axis C with back surfaces 22*d* of respective substrates 22 facing inside, and in postures extending in the same direction as the axis C, and are supported by the supporter 12. Accordingly, light is emitted to a range throughout an entire periphery around the axis C.

All of these light source units 13 are of the same structures and in the same shapes, and when the LED lamp 1 with a different light output is configured, the light source units 13 in number corresponding to a desired light output are arranged around the supporter 12.

In the LED lamp 1, gaps G1 are provided between the respective adjacent light source units 13, when the light source units 13 are disposed around the axis C. By providing the gaps G1, external air can be taken into the space R via the gap G1 to cool the light source units 13.

The light source unit 13 is equipped with a mounting board 21 on which the LED 20 is mounted, the substrate 22 to which the mounting board 21 is attached, and a cover 30 which covers the mounting board 21.

The mounting board 21 is a printed wiring board in a shape of a substantially rectangular plate, and on a surface thereof, a plurality of LEDs 20, and an electrode pattern 21*a* configuring a live part by having the above described lead wire soldered thereto, are provided. The electrode pattern 21*a* is formed at an end portion of the mounting board 21, and is electrically connected in series or parallel to the respective LEDs 20 through printed wiring not illustrated.

The LED 20 is formed by arranging a large number of LED elements in a range of a substantially rectangular shape in plan view in a lattice shape, for example, and molding surfaces thereof with a resin material with a small thickness, and a substantially entire surface thereof emits light. As shown in FIG. 6, in the mounting board 21, a plurality (two in the illustrated example) of LEDs 20 are arranged in series in the direction of the axis C with substantially no gap, so that linear light emission is obtained by these LEDs 20.

The substrate 22 is obtained by molding a metal material having high thermal conductivity such as aluminum, and forming the molded metal material into a shape of a long and narrow rectangular plate, and functions as a substrate packaging the mounting board 21, and a heat sink that receives and radiates generated heat of the LEDs 20.

Describing in more detail, as shown in FIG. 6, the substrate 22 is formed into a thin plate shape (plate shape with planes on a front and a back) of a size capable of accommodating the mounting board 21 therein, and a mounting portion 22*f* as a concave portion accommodating the mounting board 21 to be substantially flush with the mounting board 21 is formed on a front surface 22*c*. The mounting portion 22*f* is formed into a planar shape so as to be able to contact the mounting board 21, so that performance of heat transfer from the mounting board 21 to the substrate 22 is enhanced. The mounting board 21 is directly attached to the mounting portion 22*f* without the medium of a sheet-shaped electrical insulating member or the like. Consequently, heat of the mounting board 21 can be efficiently transferred to the substrate 22.

A substantially rectangular lead-out hole 23 that penetrates through the substrate 22 is provided at one end portion 22*a* in the longitudinal direction of the substrate 22, and the above described lead wire is led out to a back surface 22*d* side through the lead-out hole 23. A tube portion 24 rectangular in section which is vertically provided at a peripheral edge portion of the lead-out hole 23 is formed on the back surface 22*d*. Protrusions 25 that extend in the direction of the axis C are formed at both sides of the tube portion 24 in the back surface 22*d*. The fixing hole portion 19 is formed nearer to one end than to the tube portion 24. Further, a fixing hole portion 22*g* which is fixed by the screw 45 is provided at the one end portion 22*a*.

The substrate 22 is positioned by the tube portion 24 being inserted into the introduction hole 17 (FIG. 5), and a pair of projections 25 being fitted in both side surface portions 16*c* (FIG. 5) of the mounting portion 16, and is fixed by the screw 45.

A rod-shaped connection stay portion 26 that protrudes toward the axis C is vertically provided on the back surface 22*d* at the other end portion 22*b* in the longitudinal direction of the substrate 22. The connection stay portion 26 is provided in a central portion in the width direction of the substrate 22, and is provided in a position displaced to one end portion 22*a* side by an amount substantially corresponding to a thickness of the coupling member 14 from an end surface 27 in the longitudinal direction at the other end portion 22*b* side of the substrate 22. A screw hole 26*a* is formed in a tip end of the connection stay portion 26, and the coupling member 14 is fixed to the connection stay portion 26 by a coupling member fixing screw 28 which is fastened to the screw hole 26*a*.

A plurality of plate-shaped heat radiation fins 29 are vertically provided on the back surface 22*d* of the substrate 22. The heat radiation fins 29 are formed on a back side of the mounting portion 22*f* so as to be able to radiate heat of the mounting board 21 efficiently. The heat radiation fins 29 are provided across the entire substrate 22 in the width direction, and are provided across a section between the connection stay portion 26 and the tube portion 24, in the longitudinal direction.

The heat radiation fins 29 are disposed to be inclined with respect to the axis C. That is, the heat radiation fin 29 is provided not to be parallel with the longitudinal direction of the substrate 22, but to be inclined at a predetermined angle. Inclination angles of the respective heat radiation fins 29 are the same, and heights and thicknesses of the respective heat radiation fins 29 are the same throughout entire lengths thereof. The respective radiation fins 29 are provided to extend linearly equidistantly from one another and parallel with one another. The inclination angles of the respective heat radiation fins 29 do not have to be the same, and all of the heat radiation fins 29 do not have to be formed parallel with one another. The respective heat radiation fins do not have to be equidistant from one another.

The cover 30 covers the front surface 22*c* side of the substrate 22, and configures a water proof structure. The cover 30 is equipped with a cover main body portion 31 which is formed into a rectangular shape in front view correspondingly to the shape of the front surface 22*c* to cover the substantially entire front surface 22*c*, and an outer peripheral surface cover portion 32 that is vertically provided at an entire peripheral edge portion of the cover main body portion 31. In the cover main body portion 31, a dome-shaped bulged portion 31*a* formed into a semicircular shape in section is formed in a position corresponding to the LEDs 20. Here, a whole of the cover 30 is formed from a resin material equipped with translucency and an electrical insulating property.

The outer peripheral surface cover portion 32 is formed to be along an outer peripheral portion 22*e* of the substrate 22, and in a state where the cover 30 is mounted on the outer peripheral surface cover portion 32, an inner surface of the outer peripheral surface cover portion 32 is fitted to the outer peripheral portion 22*e* of the substrate 22.

Plate-shaped flange portions 33 protruding sideward are formed at a pair of longitudinal side outer peripheral portions 32*a* extending parallel with the axis C in the outer peripheral surface cover portion 32. The flange portion 33 is provided at a tip end in a protruding direction of the outer peripheral surface cover portion 32, and is provided substantially entirely in the longitudinal direction of the cover 30.

A waterproof packing (not illustrated) is interposed between the cover 30 and the substrate 22. The cover 30 is equipped with a seat portion 31*b* through which the screw 45 is inserted, in the cover main body portion 31. The cover main body portion 31 and the substrate 22 are fastened together to the mounting portion 16 by the screw 45.

Here, the heat radiation fin 29 will be described in detail.

In the present embodiment, the gap G1 is provided in a circumferential direction between the adjacent light source units 13, and a part of air which flows into the space R from the gaps G1 and gaps between the light source units 13 and the supporter 12 passes through air passages 35 among the respective heat radiation fins 29, and cools the heat radiation fins 29.

When the LED lamp 1 is disposed vertically so that the axis C is vertical, as shown in FIG. 2, one side in the width direction of the substrate 22 becomes an inlet port 35*a* (FIG. 7) for an air current W flowing in the air passages 35, and the other side in the width direction becomes a discharge port 35*b* for the air current W. Since the air warmed by the light source unit 13 flows upward, currents that flow from the respective inlet ports 35*a* located in lower positions to the respective discharge ports 35*b* located in higher positions are dominant.

The light source unit 13 is formed to be longer in the direction of the axis C than in the width direction, and therefore, by disposing the respective heat radiation fins 29 to be inclined with respect to the axis C, distances of the air passages 35 become shorter as compared with a case where the respective radiation fins are disposed parallel with the axis C. Consequently, the air current is allowed to flow to the air passage 35 efficiently, and the heat of the light source unit 13 can be efficiently radiated. Since the heat radiation fins 29 are inclined with respect to the axis C, the air currents passing through the heat radiation fins 29 at the lower portion side of the light source unit 13 are discharged from the discharge ports 35*b* in intermediate portions in the vertical direction, and the heat at the lower portion side can be restrained from affecting the heat radiation fins 29 at an upper portion. Consequently, heat can be prevented from being concentrated on the heat radiation fins 29 at the upper portion, and the light source unit 13 can be cooled efficiently. When the respective heat radiation fins are disposed parallel with the axis C, the inlet direction of the air currents is limited to the vertical direction, but by inclining the heat radiation fins 29, the air currents in the vertical direction and the air currents from a side can be used. Consequently, air currents can be passed to the air passages 35 efficiently, and the light source unit 13 can be efficiently cooled.

As shown in FIG. 5, the adjacent light source units 13 are the same components, and the inclination directions of the heat radiation fins 29 are the same in the adjacent light source units 13.

Figure 8:
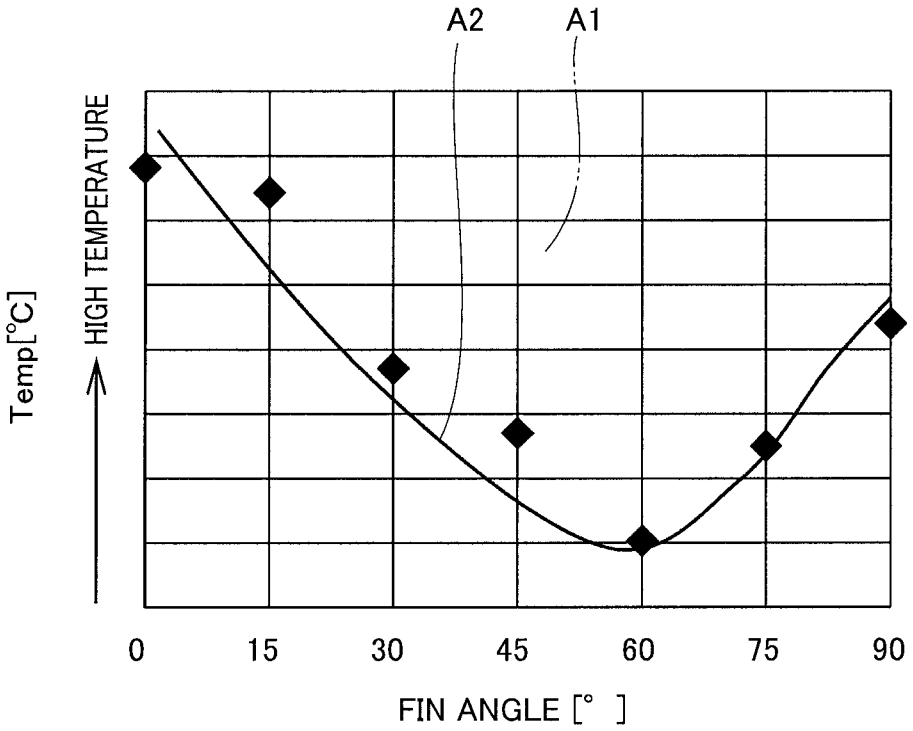
FIG. 8 is a graph showing an example of a correlation between an angle (an inclination angle) of a heat radiation fin and a temperature of the light source unit.

FIG. 8 is a graph showing an example of a correlation between an angle S (an inclination angle) of the heat radiation fin 29 and a temperature of the light source unit 13. FIG. 8 is a result of a case where the LED lamp 1 is vertically disposed, and shows a result of a test performed by the present inventors. Here, in FIG. 8, the angle S of the heat radiation fin 29 indicates an angle relative to a reference line L (FIG. 7) orthogonal to the axis C.

As shown in FIG. 8, in a case where the angle S of the heat radiation fin 29 is set as 0°, that is, an angle orthogonal to the axis C, the temperature of the light source unit 13 becomes the highest. The reason for this is considered to be because the air current does not easily pass through the air passage 35.

When the angle S of the heat radiation fin 29 is set as 15°, the temperature of the light source unit 13 becomes lower than the case of the angle S of 0°. The reason for this is considered to be because the air current easily passes through the air passage 35.

When the angle S of the heat radiation fin 29 is set as 90° C., that is, an angle parallel with the axis C, the temperature of the light source unit 13 becomes lower than the case where the angle S is set as 15°. The reason for this is considered to be because the air current passes to the air passage 35 more easily than in the case of the angle S being set as 15°.

It is found that values of the temperatures of the light source unit 13 in the case where the angle S of the heat radiation fin 29 is set at 0°, 15° and 90° can be connected by an approximation straight line A1, and the angle S of the heat radiation fin 29 and the temperature of the light source unit 13 are in a linear relation.

When the angle S of the heat radiation fin 29 is set as 30°, the temperature of the light source unit 13 significantly reduces to be lower than in the case where the angle S is set as 15°, and is much lower than a temperature predicted from the approximation straight line A1. The temperature of the light source unit 13 in a case where the angle S of the heat radiation fin 29 is set at 30° becomes lower than a case where the angle S of the heat radiation fin 29 is set at 90°. The reason for this is considered to be because the effect of being capable of efficiently passing the air current to the air passage 35 is obtained by inclining the heat radiation fin 29 with respect to the axis C, and the effect is remarkably exhibited by setting the angle S at 30°.

When the angle S of the heat radiation fin 29 is set as 45° C., the temperature of the light source unit 13 is lower than the case where the angle S is set as 30°, and is much lower than the temperature predicted from the approximation straight line A1.

when the angle S of the heat radiation fin 29 is set as 60°, the temperature of the light source unit 13 becomes the lowest, and is much lower than the temperature predicted from the approximation straight line A1.

When the angle S of the heat radiation fin 29 is set as 75°, the temperature of the light source unit 13 becomes equivalent to the temperature in the case where the angle S is set as 45°, and is much lower than the temperature predicted from the approximation straight line A1.

Values of the temperatures of the light source unit 13 in a case where the angle S of the heat radiation fin 29 is set at 0°, 30°, 45°, 60°, 75° and 90° can be connected by an approximation curve A2. The approximation curve A2 is a substantially two-dimensional curve in which the temperature of the light source unit 13 becomes the lowest when the angle S of the heat radiation fin 29 is 60°.

From the experimental result, it has become clear that when the angle S of the heat radiation fin 29 is in a range from 25° to 85°, a dominant difference with respect to the result predicted from the approximation straight line A1 is seen. By setting the angle S of the heat radiation fin 29 to be within the range from 25° to 85°, the light source unit 13 can be effectively cooled by the heat radiation fins 29. Further, it is more preferable to set the angle S of the heat radiation fin 29 to be within a range from 45° to 75°, because the temperature of the light source unit 13 can be greatly reduced.

Figure 9:
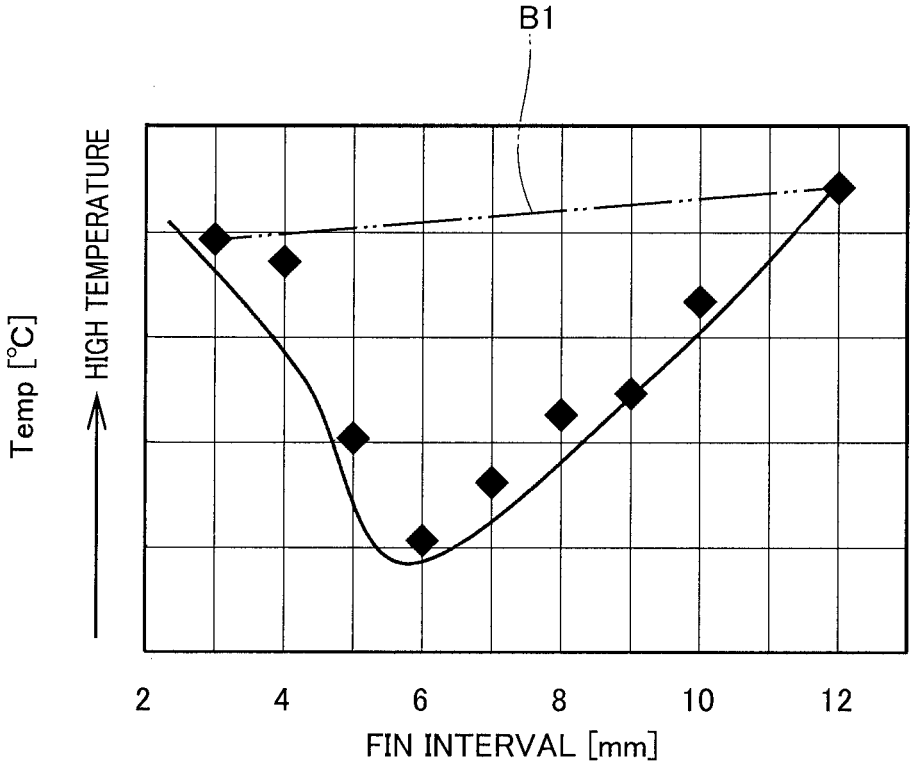
FIG. 9 is a graph showing an example of a correlation between an interval between the heat radiation fins and the temperature of the light source unit.

FIG. 9 is a graph showing an example of a correlation between an interval between the heat radiation fins 29 and the temperature of the light source unit 13. FIG. 9 shows a result of a test performed by the present inventors, which is a result of a case where the angle S of the heat radiation fin 29 is set at 60°, and the LED lamp is vertically disposed. Here, in FIG. 9, the interval between the heat radiation fins 29 is a distance between opposing surfaces of the adjacent heat radiation fins 29.

As shown in FIG. 9, the temperature of the light source unit 13 becomes higher in a case where the interval between the heat radiation fins 29 is set at 12 mm than in a case where the interval between the heat radiation fins 29 is set at 3 mm. The values of the temperatures of the light source unit 13 in the case where the intervals between the heat radiation fins 29 are set at 3 mm and 12 mm can be connected by an approximation straight line B1.

When the interval between the heat radiation fins 29 is changed between 3 mm and 12 mm, the temperature of the light source unit 13 becomes lower as the interval becomes larger from 3 mm, and becomes the lowest when the interval is 6 mm. The temperature of the light source unit 13 becomes higher as the interval between the heat radiation fins 29 becomes larger from 6 mm, and becomes the highest when the interval is 12 mm. It is conceivable that by setting the interval between the heat radiation fins 29 at 6 mm, air currents can be passed to the air passages 35 efficiently.

From the experimental result, it has become clear that by setting the interval between the heat radiation fins 29 within a range from 4 mm to 11 mm, the temperature of the light source unit 13 can be made lower than the temperature predicted from the approximation straight line B1. It is more preferable to set the interval between the heat radiation fins 29 in a range from 5 mm to 9 mm, because the temperature of the light source unit 13 can be greatly reduced.

In the present embodiment, an electric shock prevention structure is provided so that a finger does not touch the substrate 22 and the heat radiation fin 29 from outside the LED lamp 1. Hereinafter, the electric shock prevention structure will be described.

As shown in FIG. 6 and FIG. 7, the outer peripheral surface cover portion 32 of the cover 30 is formed to be higher than the outer peripheral portion 22*e* of the substrate 22, and as in FIG. 7 (*a*), the outer peripheral portion 22*e* is lower by one step than the outer peripheral surface cover portion 32 when the light source unit 13 is seen from the back surface 22*d* side. As shown in FIG. 7 (*c*), in side view, the outer peripheral portion 22*e* is completely covered with the outer peripheral surface cover portion 32, and is not exposed to outside. The outer peripheral surface cover portion 32 is formed integrally with the cover 30, and is formed from an insulating material.

The outer peripheral surface cover portion 32 has a plurality of claw portions 34 that protrude inside the cover 30, at tip end portions, and the cover 30 is fixed to the substrate 22 by the claw portions 34 being caught by ends of the outer peripheral portion 22*e* of the substrate 22.

As shown in FIG. 1 to FIG. 3, in the LED lamp 1, the substrate 22 is covered with the outer peripheral surface cover portion 32 of the cover 30, so that a worker or the like does not directly touch the substrate 22, and is prevented from having an electric shock by touching the substrate 22.

The respective light source units 13 are disposed to form the space R in a shape of a substantially equilateral polygon (a substantially equilateral triangle in the present embodiment) inside thereof, and the gaps G1 are formed in positions of respective vertex portions of the above described substantially equilateral polygon. The gaps G1 are gaps in a circumferential direction of the LED lamp 1, which are formed among the respective adjacent light source units 13, and a size of the gap G1 is adjusted by extending the flange portion 33 to the gap G1 from the cover 30.

That is, the gap G1 is a gap between tip ends of the adjacent flange portions 33. The size of the gap G1 is set so that a test finger T in a predetermined shape formed to represent a human finger enters the space R up to only a predetermined depth. In more detail, the above described predetermined depth is such a depth that the test finger T (FIG. 3) entering the space R does not touch the heat radiation fins 29. Consequently, while the heat radiation fins 29 are configured to be cooled by taking in air from the gaps G1, the finger of a worker or the like can be prevented from touching the heat radiation fins 29 after entering the space R, by the flange portions 33.

As shown in FIG. 3 to FIG. 5, the coupling member 14 is a plate-shaped lid formed into a shape of a substantially equilateral polygon that is one size smaller than the substantially equilateral polygonal shape of the space R, and closes an opening that is defined and formed by the other end portions 13*b* of the light source units 13.

The coupling member 14 is equipped with air holes 40 at respective vertex portions of the substantially equilateral polygonal shape, and also equipped with a central hole 41 in a central portion overlapping the axis C.

The coupling member 14 is equipped with seat portions 42 through which the coupling member fixing screws 28 are inserted between the respective adjacent air holes 40.

A surface 14*a* of the coupling member 14 is flat except for portions of the holes. Receiving portions 43 that protrude to the space R side are respectively formed in positions corresponding to the respective seat portions 42 on a back surface of the coupling member 14.

The coupling member 14 is connected to the respective light source units 13 by the receiving portions 43 being placed on the connection stay portions 26, and the coupling member fixing screws 28 which are inserted through the seat portions 42 being fastened to the screw holes 26*a*. That is, the other end portions 13*b* of the respective light source units 13 are integrally coupled via the coupling member 14, and an upper end of the space R is closed by the coupling member 14.

The surface 14*a* of the coupling member 14 is provided substantially flush with upper end surfaces 30*a* (tip end surfaces) of the covers 30 of the light source units 13. Consequently, even with the configuration which enhances rigidity of the light source units 13 by providing the coupling member 14, the LED lamp 1 can be made compact.

Since the coupling member 14 is one size smaller than the substantially equilateral polygonal shape of the space R, an upper gap G2 (FIG. 10) is formed between an outer peripheral surface of the coupling member 14 and the light source unit 13. In this way, the upper gaps G2, the air holes 40 and the central hole 41 are provided on the coupling member 14 side, air can flows in and out from the space R through the upper gaps G2, the air holes 40 and the central hole 41, so that heat can be effectively radiated by the heat radiation fins 29.

The upper gap G2 is set to be in a size that is smaller than the gap G1, and does not allow the test finger T to touch the heat radiation fins 29 through the upper gap G2. Consequently, the finger of a worker or the like is prevented from touching the heat radiation fins 29.

The air holes 40 and the central hole 41 of the coupling member 14 are set to be in such a size that the test finger T does not touch the heat radiation fins 29 through the air holes 40 and the central hole 41. Consequently, the finger of a worker or the like is prevented from touching the heat radiation fin 29.

Figure 10:
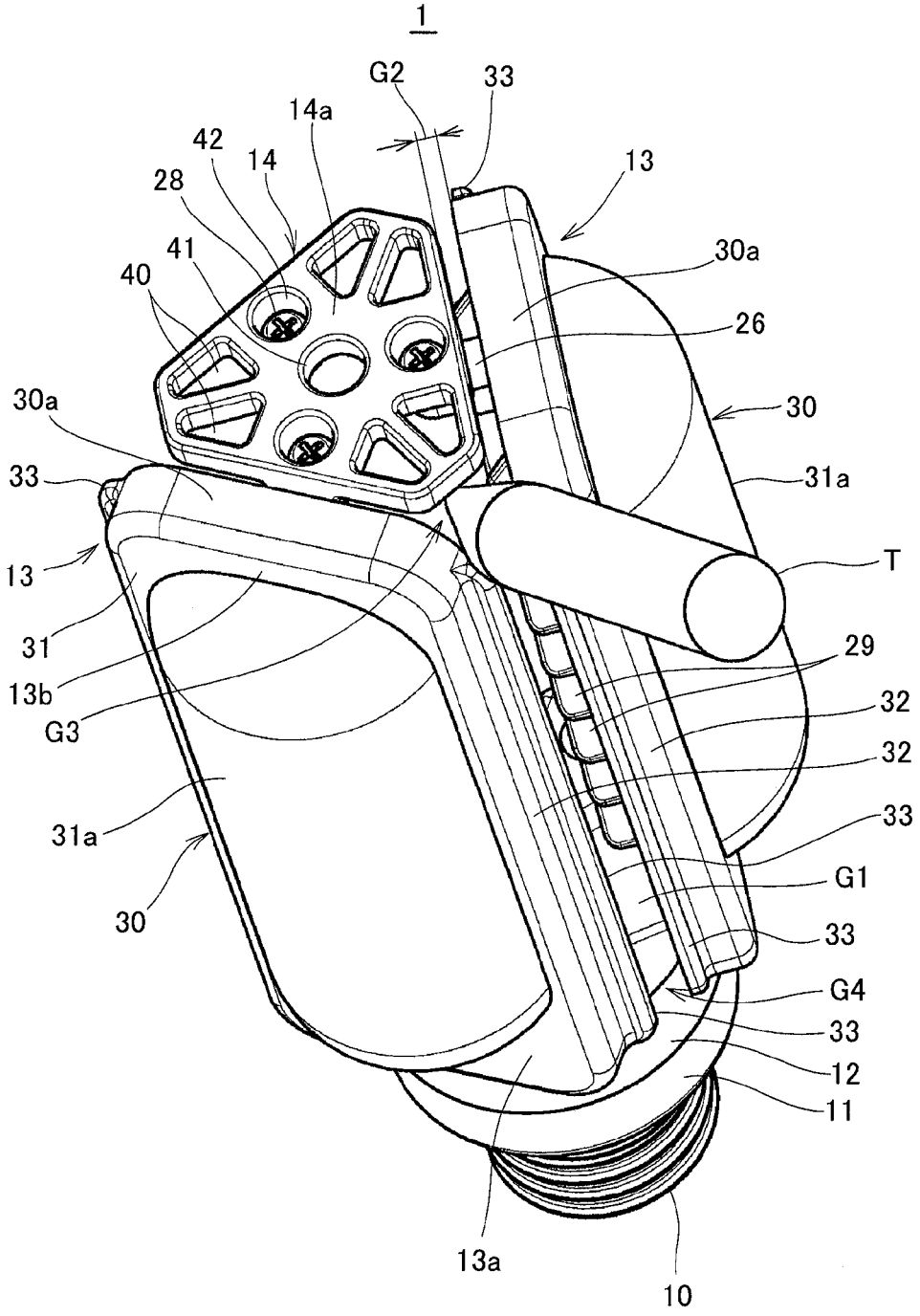
FIG. 10 is a perspective view of the LED lamp seen from above.

FIG. 10 is a perspective view of the LED lamp 1 seen from above. FIG. 10 shows a state where one of the light source units 13 is removed.

As shown in FIG. 10, a relatively large corner portion gap G3 is formed between a vertex portion of the substantially equilateral polygonal shape of the coupling member 14 and an upper end of the gap G1. The corner portion gap G3 is set to be in such a size that the test finger T does not touch the heat radiation fins 29 through the corner portion gap G3. Consequently, while a configuration that allows air to flow in and out from the space R through the corner portion gap G3 is adopted, the finger of a worker or the like can be prevented from touching the heat radiation fins 29.

Further, at the one end portion 13*a* side, a relatively large corner portion gap G4 is formed between the supporter 12 and a lower end of the gap G1. The corner portion gap G4 is set to be in such a size that the test finger T does not touch the heat radiation fins 29 through the corner portion gap G4. Consequently, while a configuration that allows air to flow in and out from the space R through the corner portion gap G4 is adopted, the finger of a worker or the like can be prevented from touching the heat radiation fin 29.

As described above, according to the first embodiment to which the present invention is applied, the LED lamp 1 is equipped with a plurality of light source units 13 each having the mounting board 21 on which the LEDs 20 are mounted on the surface 22*c* of the substrate 22, these plurality of light source units 13 are disposed around the axis C of the LED lamp 1 with the back surfaces 22*d* of the respective substrates 22 facing inward, and with the gaps G1 left from one another, and the heat radiation fins 29 disposed to be inclined with respect to the axial direction of the axis C are provided on the back surfaces 22*d* of the substrates 22. Accordingly, air currents can be passed to the air passages 35 which are flow passages among the heat radiation fins 29 from the direction of the axis C of the LED lamp 1 and the directions different from the direction of the axis C, and air currents can be efficiently passed to the air passages 35 among the heat radiation fins 29, so that the heat of the LED lamp 1 can be efficiently radiated by the heat radiation fins 29. Further, the air currents passing through the heat radiation fins 29 at the lower portion side of the light source unit 13 are discharged from the discharge ports 35*b* in the intermediate portion in the vertical direction, so that the heat can be prevented from being concentrated on the heat radiation fins 29 in the upper portion, and the light source unit 13 can be efficiently cooled.

Further, the light source unit 13 is formed to be longer in the direction of the axis C than in the width direction, and a plurality of LEDs 20 are disposed side by side in the direction of the axis C. Accordingly, the distance of the air passage 35 for the air current along the heat radiation fin 29 can be made short, and the air current can be efficiently passed to the air passages 35 among the heat radiation fins 29, so that the heat of the LED lamp 1 can be efficiently radiated by the heat radiation fins 29.

Further, the angle S of the heat radiation fin 29 with respect to the reference line L orthogonal to the axis C is within the range from 25° to 85°, so that air currents can be efficiently passed to the air passages 35 among the heat radiation fins 29, and the heat of the LED lamp 1 can be efficiently radiated by the heat radiation fins 29.

Further, the interval between the heat radiation fins 29 is set to be in the range from 4 mm to 11 mm, and thereby heat can be efficiently radiated.

Further, according to the first embodiment to which the present invention is applied, the LED lamp 1 is equipped with a plurality of light source units 13 each having the mounting board 21 on which the LEDs 20 are mounted, on the surface 22*c* of a substantially plate-shaped substrate 22 made of a metal, and the supporter 12 which is formed from an insulating substance and supports the plurality of light source units 13, the light source units 13 are each equipped with the cover 30 which covers the mounting board 21 and the outer peripheral portion 22*e* of the substrate 22 and is formed from an insulating material, and are disposed around the axis C of the LED lamp 1 with the one end portions 13*a* thereof mounted to cover the supporter 12 from around, and the back surfaces 22*d* of the respective substrates 22 facing inside, and the LED lamp 1 is equipped with the coupling member 14 which closes the opening formed by the other end portions 13*b* of the plurality of light source units 13 and is formed from an insulating material. Consequently, a finger can be prevented from touching the outer peripheral portion 22*e* by the cover 30 which covers the outer peripheral portion 22*e* of the substrate 22 and is formed from an insulating material. Since the opening formed by the other end portions 13*b* of the light source units 13 is closed by the coupling member 14 formed from an insulating material, a finger can be prevented from entering the opening formed by the other end portions 13*b* by the coupling member 14 formed from an insulating material, and a finger can be prevented from touching the heat radiation fins 29. Accordingly, it is not necessary to cover the entire LED lamp 1 with a cover or the like, so that the heat radiation performance of the LED lamp 1 can be ensured, and an electric shock can be prevented.

Since the cover 30 which covers the outer peripheral portion 22*e* and the coupling member 14 are provided, a finger can be prevented from touching the heat radiation fins 29 on the back surface 22*d* of the substrate 22.

Further, since the air holes 40 are formed in the coupling member 14, favorable heat radiation performance is obtained while an electric shock is prevented.

Furthermore, since the flange portions 33 protruding to the gap G1 between the light source units 13 are provided, an electric shock can be prevented by preventing a finger from entering the gap G1 with the flange portions 33, and heat can be radiated from the gap G1.

Since the mounting board 21 is directly attached to the substrate 22, heat is efficiently transferred to the substrate 22 from the mounting board 21. Consequently, heat can be efficiently radiated through the heat radiation fins 29. Even with the configuration in which the mounting board 21 is directly attached to the substrate 22, a finger is prevented from touching the substrate 22 by the above described electric shock prevention structure.

The coupling member 14 couples the other end portions 13*b* to one another, and is provided to be substantially flush with the upper end surfaces 30*a* of the other end portions 13*b*. Consequently, an electric shock can be prevented with a simple configuration by using the coupling member 14 which couples the other end portions 13*b*, and the LED lamp 1 can be made compact because the coupling member 14 does not protrude.

Note that the above described first embodiment shows one mode of application of the present invention, and the present invention is not limited to the above described first embodiment.

Although in the above described first embodiment, it is described that the gap G1 is the gap between the tip ends of the adjacent flange portions 33, the present invention is not limited thereto. For example, the size of the gap G1 may be set by adjusting the thickness of the outer peripheral surface cover portion 32 without providing the flange portion 33.

Although in the above described first embodiment, it is described that the LED lamp 1 is vertically disposed so that the axis C becomes vertical, the present invention is not limited thereto, and the LED lamp 1 may be disposed by being laid lengthwise. For example, horizontal disposition in which the axis C points to the horizontal direction is possible, and since in this case, the heat radiation fins 29 are also inclined with respect to the air currents in the vertical direction, air can be taken in from the gaps G1 among the respective light source units, and the air warmed by the heat from the LEDs 20 flows outside from the gaps G1 at the opposite sides, so that heat can be efficiently radiated.

Further, it is described that in the above described first embodiment, the cover 30 formed from an insulating material covers the mounting board 21 and the outer peripheral portion 22*e* of the substrate 22, the cover 30 does not have to be a single piece. For example, the outer peripheral surface cover portion 32 and the cover main body portion 31 may be formed of separate pieces, and the outer peripheral surface cover portion 32 may be formed from an insulating matter.

In the above described first embodiment, it is described that the light source units 13 are disposed to form the space R in a substantially equilateral triangular shape inside thereof, but the space R is not limited thereto, and the light source units 13 may be disposed to form a space in a substantially regular square inside thereof. In this case, in accordance with the shape of the above described space, the coupling member 14 is also formed into a substantially regular square.

In the above described first embodiment, it is described that the respective heat radiation fins 29 are provided to extend rectilinearly, the present invention is not limited thereto. In the entire flow passage, the respective heat radiation fins 29 can be inclined with respect to the axis C between the inlet port 35*a* and the discharge port 35*b*, and may be curbed between the inlet port 35*a* and the discharge port 35*b*, for example.

Second Embodiment

Hereinafter, with reference to FIG. 11, a second embodiment to which the present invention is applied will be described. In the second embodiment, the parts configured similarly to those in the above described first embodiment will be assigned with the same reference signs, and explanation thereof will be omitted.

In the above described first embodiment, it is described that the height of each of the heat radiation fins 29 is the same throughout the entire length, but the second embodiment differs from the above described first embodiment in a point that the height of the heat radiation fin 29 varies in the length direction thereof.

Figure 11:
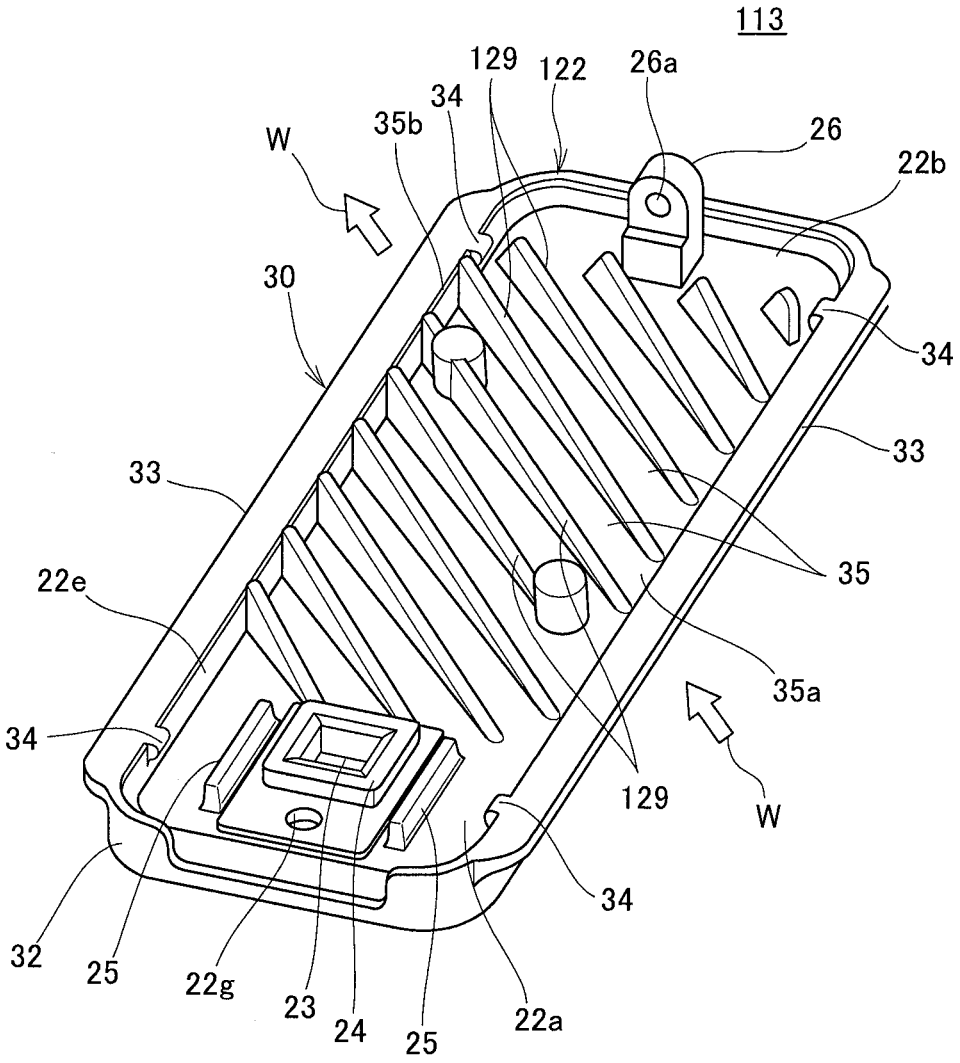
FIG. 11 is a perspective view of a light source unit of a second embodiment seen from a back surface side.

FIG. 11 is a perspective view of a light source unit 113 of the second embodiment seen from a back surface side.

The light source unit 113 is equipped with a substrate 122 and the cover 30. The substrate 122 is the same as the substrate 22 except for a shape of a heat radiation fin 129.

The heat radiation fin 129 is formed so that a height thereof becomes gradually higher towards the discharge port 35*b* from the inlet port 35*a* side for the air current W.

According to the second embodiment, a portion of the heat radiation fin 129 at the discharge port 35*b* side, where the heat can be efficiently radiated by the air current being shaped by being rectified by the heat radiation fin 129, is made higher than a portion at the inlet port 35*a* side, so that the heat radiation fin 129 can be made light while the heat radiation performance of the heat radiation fin 129 is ensured.

Third Embodiment

Hereinafter, with reference to FIG. 12, a third embodiment to which the present invention is applied will be described. In the third embodiment, the parts configured similarly to those in the above described first embodiment will be assigned with the same reference signs, and explanation thereof will be omitted.

In the above described first embodiment, it is described that the adjacent light source units 13 are the same components, and the inclination directions of the heat radiation fins 29 are the same in the adjacent light source units 13. The third embodiment differs from the above described first embodiment in a point that the inclination directions of the heat radiation fins 29 differ between the adjacent light source units 13.

Figure 12:
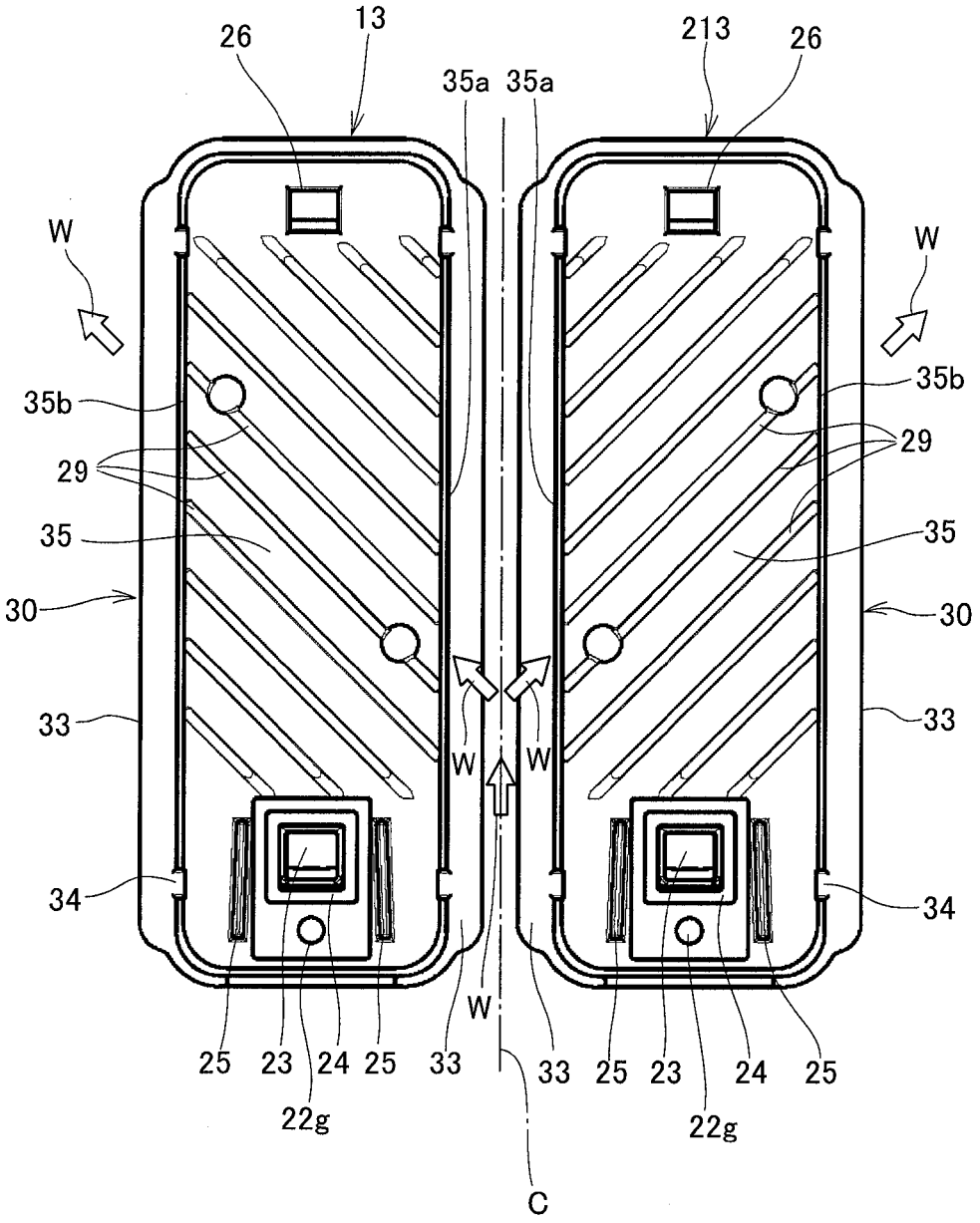
FIG. 12 is a plan view showing the light source unit and a light source unit of a third embodiment.

FIG. 12 is a plan view showing the light source unit 13 and a light source unit 213 of the third embodiment. Here, FIG. 12 shows a state where the light source unit 13 and the light source unit 213 are developed into a plane in an orientation of the light source units 13 and 213 being removed from the LED lamp 1.

The light source unit 213 is formed to be symmetrical with the light source unit 13 with the axis C as the reference. Since the light source unit 13 and the light source unit 213 are laterally symmetrical, the respective parts will be assigned with the same reference signs and explanation thereof will be omitted here.

The light source unit 13 and the light source unit 213 are disposed so that the inlet ports 35*a* are adjacent to each other, and the discharge ports 35*b* are in locations far from each other.

According to the third embodiment, the heat radiation fins 29 of the light source unit 13 and the light source unit 213 adjacent to each other are formed to be substantially symmetrical with the axis C as the reference, so that the warmed air current W which is discharged from the discharge ports 35*b* of the heat radiation fins 29 of one light source unit 13 of the adjacent light source units can be prevented from flowing into the inlet ports 35*a* of the heat radiation fins 29 of the other light source unit 213. Consequently, influence of the heat from the adjacent light source unit is hardly exerted, and heat can be efficiently radiated by the heat radiation fins 29.

REFERENCE SIGNS LIST

1 LED lamp (lamp)
13, 113, 213 light source unit
20 LED (light emitting element)
21 mounting board
22, 122 substrate
22*d* back surface
29, 129 heat radiation fin
35*a* inlet port (inlet side)
35*b* discharge port (discharge side)
C axis
G1 gap
L reference line
S angle

The invention claimed is:

1. A lamp, comprising:

a plurality of light source units each having a substrate;

a mounting board on which a light emitting element is mounted; and a lid body provided so as to close an opening formed by end portions of the plurality of light source units, wherein the mounting board is connected to a front surface of the substrate, wherein the plurality of light source units are disposed around an axis of the lamp, wherein a back surface of each of the respective substrates faces inside toward the axis, wherein each of the plurality of light source units is separated from adjacent light source units by a gap, wherein each of the plurality of light source units comprises a cover which covers an entire front surface of the substrate and extends along an outer peripheral portion of the substrate, and whose inner surface is fitted to the outer peripheral portion of the substrate, wherein a plurality of heat radiation fins are provided on the back surface of the substrate and are inclined with respect to a direction of the axis, an air passage being formed between the heat radiation fins, wherein, for each light source unit, an inlet port of the air passage communicates with the gap at one side of the respective light source unit in a width direction of the respective substrate, and a discharge port of the air passage communicates with the gap at the other side of the respective light source unit in the width direction of the respective substrate, wherein the lid body is disposed at an edge side of each of the heat radiation fins in the axis direction within a space surrounded and formed by the plurality of light source units, the lid body coupling the plurality of light source units with each other, the space having a shape of a substantially equilateral polygon, wherein each of the plurality of light source units comprises a connection stay portion on the back surface of the substrate, wherein the connection stay portion of each light source unit is provided at a position below an end surface of the substrate at a side of the substrate comprising the opening that is closed by the lid body, wherein a lower surface of the lid body is placed on the connection stay portion and disposed inside of the space, wherein an upper surface of the lid body is flush with an upper end surface of each of the covers, wherein an outer peripheral surface of the lid body has a shape of a substantially equilateral polygon along each of the back surfaces of the substrates, and the lid body is provided with an upper gap for air flow between the outer peripheral surface of the lid body and the back surfaces, and wherein the substantially equilateral polygonal shape of the lid body is smaller than the substantially equilateral polygonal shape formed by the space.

2. The lamp according to claim 1, wherein each of the plurality of light source units is formed to be longer in the axial direction than in a width direction thereof, and a plurality of light emitting elements are disposed side by side in the axial direction.

3. The lamp according to claim 1, wherein an inclination angle of each of the plurality of heat radiation fins with respect to a reference line orthogonal to the axis is in a range from 25° to 85°.

4. The lamp according to claim 1, wherein an interval between the heat radiation fins is in a range from 4 mm to 11 mm.

5. The lamp according to claim 1, wherein each of the plurality of heat radiation fins is formed so that a height at a discharge side is higher than a height at an inlet side of the air passage.

6. The lamp according to claim 1, wherein heat radiation fins of the adjacent light source units are formed to be substantially symmetrical with respect to the axis, and the inlet ports or the discharge ports face each other.

7. The lamp according to claim 1, wherein each of the plurality of heat radiation fins continues from the inlet port to the discharge port.

8. The lamp according to claim 1, wherein an inclination angle of each of the plurality of heat radiation fins with respect to a reference line orthogonal to the axis is in a range from 55° to 65°.

9. The lamp according to claim 1, wherein the lid body comprises an electrically insulating material, and an air hole is formed in the lid body.

* * * * *